US005825168A

United States Patent [19]

Kimber

[11] Patent Number: 5,825,168

[45] Date of Patent: Oct. 20, 1998

[54] HIGH PERFORMANCE MAXIMUM AND MINIMUM CIRCUIT

[75] Inventor: Kurt N. Kimber, Minneapolis, Minn.

[73] Assignee: VTC, Inc., Bloomington, Minn.

[21] Appl. No.: 874,762

[22] Filed: Jun. 13, 1997

[51] Int. Cl.[6] ..... G05F 3/16

[52] U.S. Cl. ..... 323/315; 323/313

[58] Field of Search ..... 3223/312, 313, 3223/314, 315

[56] References Cited

U.S. PATENT DOCUMENTS

| | | | |
|---|---|---|---|
| 5,374,897 | 12/1994 | Moraveji | 330/252 |
| 5,514,950 | 5/1996 | Sevenhans et al. | 323/315 |
| 5,515,010 | 5/1996 | Peterson | 323/315 |

OTHER PUBLICATIONS

Paul R. Gray and Robert G. Meyer entitled "Analysis and Design of Analog Integrated Circuits", John Wiley & Sons, Inc., Third Edition, Chapter 3, pp. 227–230.

*Primary Examiner*—Peter S. Wong
*Assistant Examiner*—Bao Q. Vu
*Attorney, Agent, or Firm*—Kinney & Lange

[57] ABSTRACT

The present invention is a circuit for producing an output voltage as a function of a first input voltage and a second input voltage. The circuit includes a first emitter-coupled transistor pair for receiving the first and second input voltages. The circuit further includes a compensation circuit coupled to receive the first and the second input voltage signals. The compensation circuit generates a compensation current that is at least partially based on a relative difference between the first and the second input voltage signals. The compensation circuit is coupled to the first emitter-coupled transistor pair such that the compensation circuit provides the compensation current to the first emitter-coupled transistor pair. The output signal is representative of either the first or the second input voltage.

13 Claims, 7 Drawing Sheets

HIGH PERFORMANCE MAXIMUM AND MINIMUM CIRCUIT

BACKGROUND OF THE INVENTION

The present invention relates to a high performance circuit for generating an output signal representative of one of two input signals having variable and possibly closely related potentials.

Emitter-coupled pairs are widely used two-transistor subcircuits in monolithic analog circuits. The usefulness of this circuit stems from the fact that cascades of emitter-coupled pairs of bipolar transistors can be directly coupled to one another without interstage coupling capacitors. Furthermore, the differential input characteristics provided by the emitter-coupled pair are required in many types of analog circuits. For example, the emitter-coupled pair may be used to produce a single-ended output signal representative of either if the two input signals based on which signal has a higher or lower potential, when the output is taken from the node that the two emitters share.

Use of emitter-coupled pairs in this way, however, traditionally presents limitations. For example, when two input signals are applied to the respective bases of an emitter-coupled pair and an output signal is produced, the output signal will generally represent the higher of the two input signals. When the two input voltages are close in potential, however, the output signal will no longer accurately represent the higher of the two input signals. As the two input signals approach an equal potential, the transistor with a lower input signal at its base will not shut off completely, thereby diverting some of the emitter current. As a result, the output signal will be relatively higher than it would in the situation when the two input signals are not close in potential. A circuit that could overcome the limitations in the prior art would be useful.

BRIEF SUMMARY OF THE INVENTION

The present invention is a circuit for producing an output voltage that is based on a first input voltage or a second input voltage. The circuit includes a first emitter-coupled transistor pair for receiving the first and second input voltages. The circuit provides a compensation current to the emitter-coupled transistor pair. The compensation current is generated in a compensation circuit that is coupled to the emitter-coupled transistor pair. The compensation current is at least partially based on a relative difference between the first and the second input voltage signals.

In one embodiment of the invention, a circuit generates a compensation current that aids in providing an output that represents the higher of the first and second input voltages. In another embodiment of the invention, a circuit generates a compensation current that aids in providing an output that represents the lower of the first and second input voltages.

DETAILED DESCRIPTION OF THE PREFERRED EMBODIMENTS

Figure 1:
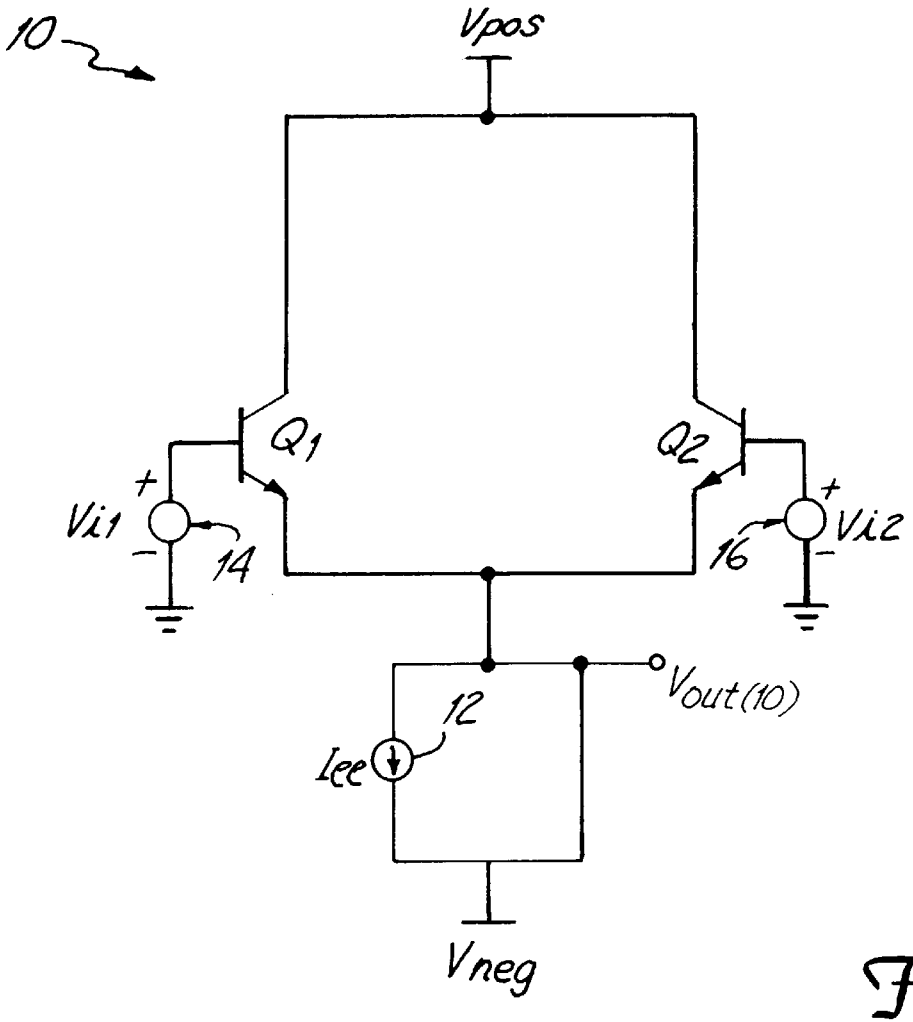
Fig. 1 (PRIOR ART)
FIG. 1 is a circuit diagram of an emitter-coupled transmitter pair used in prior systems

FIG. 1 shows circuit 10, which includes an emitter-coupled transistor pair in accordance with prior circuits. Circuit 10 includes transistors Q1 and Q2 and current source 12. Transistors Q1 and Q2 are each NPN transistors with a base, a collector and an emitter.

The emitter of transistor Q1 is coupled to the emitter of transistor Q2 to form an emitter-coupled transistor pair. Current source 12 is coupled between the emitters of transistors Q1 and Q2 and negative supply voltage $V_{neg}$.

In operation of circuit 10, a first voltage source 14 is applied to the base of transistor Q1 as a first input voltage $V_{i1}$, while a second voltage source 16 is applied to the base of transistor Q2 as a second input voltage $V_{i2}$. Output voltage $V_{out(10)}$ is measured from the node shared by the emitters of transistors Q1 and Q2 and by current source 12. Circuit 10 may be useful in relating first and second input voltages $V_{i1}$ and $V_{i2}$, to output voltage $V_{out(10)}$. In order to understand the relationship between first and second input voltages $V_{i1}$ and $V_{i2}$, and output voltage $V_{out(10)}$, it is helpful to perform some circuit analysis. For simplicity of analysis, the output resistance of current source 12 is assumed infinite, and the base resistance of each transistor Q1 and Q2 is assumed negligible. These assumptions do not strongly affect the low-frequency, large-signal behavior of the circuit.

The sum of the voltages around a loop consisting of first and second voltage sources 14 and 16 and the two base-emitter junctions of Q1 and Q2 is:

$$V_{i1}-V_{be1}+V_{be2}-V_{i2}0 \qquad \text{(EQUATION 1)}$$

If the values of both $V_{be1}$ and $V_{be2}$ are much less than $V_t$, then from the Eber-Moll equations:

$$V_{be1}=V_t \text{In } I_{c1}/I_{s1} \qquad \text{(EQUATION 2)}$$

$$V_{be2}=V_t \text{In } I_{c2}/I_{s2} \qquad \text{(EQUATION 3)}$$

where $I_{c1}$ is the collector current in transistor Q1, $I_{c2}$ is the collector current in transistor Q2, $I_{s1}$ is the scale current in transistor Q1, and $I_{s2}$ is the scale current in transistor Q2.

If the difference between $V_{i1}$ and $V_{i2}$ is defined as $V_{id}$, and if scale currents $I_{s1}$ and $I_{s2}$ in transistors Q1 and Q2 are equal, then combination of EQUATIONS 1–3 provides:

$$I_{c1}/I_{c2}=\exp\ (V_{i1}-V_{i2}/V_t)=\exp\ (V_{id}/V_t) \qquad \text{(EQUATION 4)}$$

Summing currents of the emitter currents $I_{e1}$ and $I_{e2}$ of transistors Q1 and Q2 yields:

$$-(I_{e1}+I_{e2})=I_{ee}=(1/\alpha_f)(I_{c1}+I_{c2}) \qquad \text{(EQUATION 5)}$$

Combining EQUATIONS 4 and 5:

$$I_{c1}=(\alpha_f I_{ee})/(1+\exp\ (-V_{id}/V_t)) \qquad \text{(EQUATION 6)}$$

$$I_{c2}=(\alpha_f I_{ee})/(1+\exp\ (V_{id}/V_t)) \qquad \text{(EQUATION 7)}$$

Since $I_c=\alpha I_e$, EQUATIONS 6 and 7 may then be rewritten in terms of the emitter currents:

$$I_{e1}=I_{ee}/(1+\exp(-V_{id}/V_t)) \quad \text{(EQUATION 8)}$$

$$I_{e2}=I_{ee}/(1+\exp(V_{id}/V_t)) \quad \text{(EQUATION 9)}$$

For large voltage differences between input voltages $V_{i1}$ and $V_{i2}$, output voltage $V_{out(10)}$ may be calculated by summing the voltages in a either a loop including transistor Q1 and current source 12, or a loop including transistor Q2 and current source 12. Thus, for large voltage differences between input voltages $V_{i1}$ and $V_{i2}$, $$V_{out(10)}=\max[(V_{i1}-V_{be1}), (V_{i2}-V_{be2})] \quad \text{(EQUATION 10)}$$

where $V_{be1}$ is the base-emitter voltage drop in transistor Q1 and $V_{be2}$ is the base-emitter voltage drop in transistor Q2. Using $I_c=\alpha I_e$ and EQUATIONS 2 and 3:

$$V_{out(10)}=\max[(V_{i1}-V_t \ln I_{e1}/\alpha_1 I_{s1}), (V_{i2}-V_t \ln I_{e2}/\alpha_2 I_{s2})] \quad \text{(EQUATION 11)}$$

Finally, if transistors Q1 and Q2 are matched such that $\alpha_1=\alpha_2$, and such that $I_{s1}=I_{s2}$, and using basic logarithmic properties:

$$V_{out(10)}=\max[(V_{i1}-V_t \ln I_{e1}), (V_{i2}-V_t \ln I_e)] \quad \text{(EQUATION 12)}$$

Figure 2:
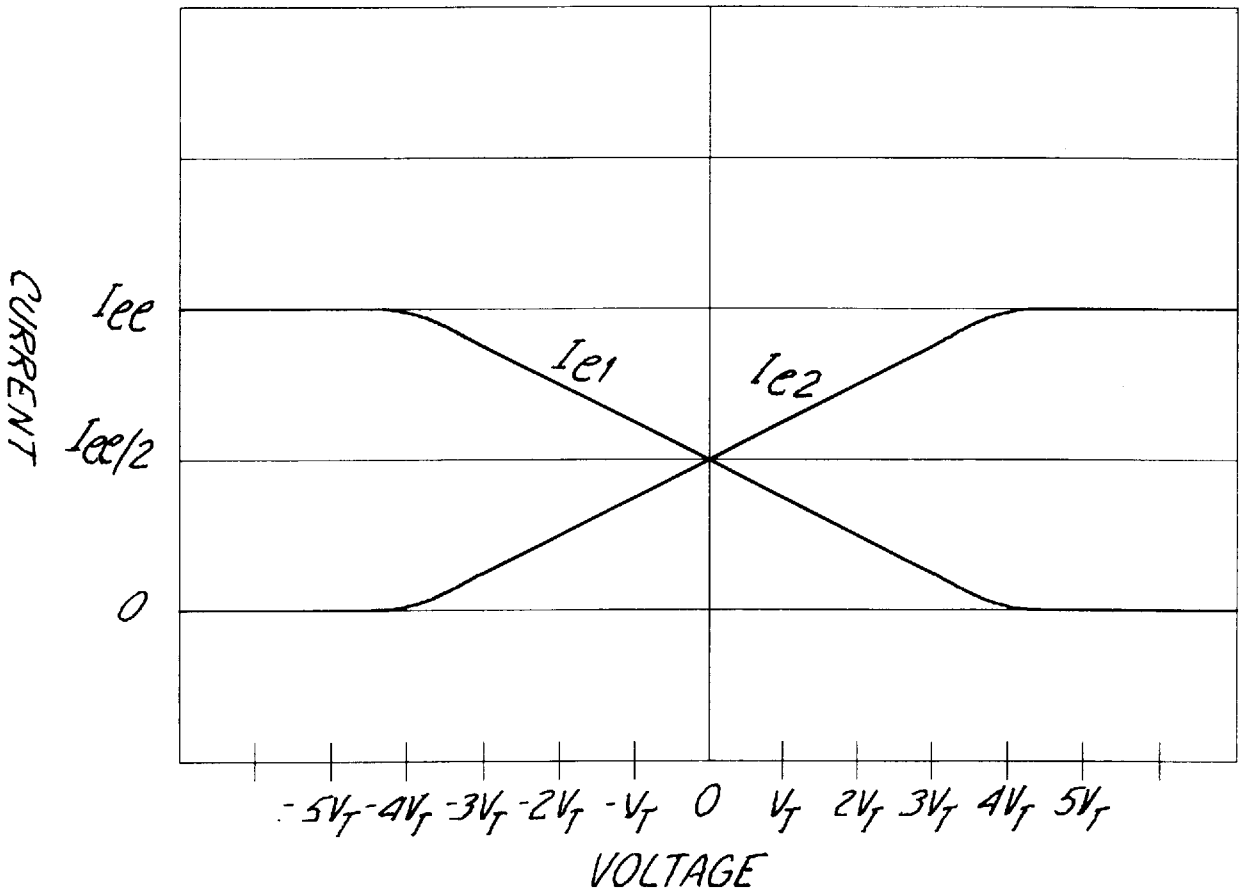
FIG. 2 is a graph relating emitter current to a voltage differential of two input signals

EQUATION 12 demonstrates that output voltage $V_{out(10)}$ for an emitter-coupled transistor pair is a function of the emitter currents $I_{e1}$ and $I_{e2}$. First and second emitter currents $I_{e1}$ and $I_{e2}$ are shown as a function of $V_{id}$ in FIG. 2. As seen in FIG. 2, the emitter currents become independent of $V_{id}$ for input voltage differences of greater than approximately $4V_t$, since all the current is flowing in one of the transistors in that situation. Circuit 10 has significant error, however, for differential input voltage differences less than $4V_t$. Typically, the emitter currents become independent of $V_{id}$ for differences of several hundred millivolts.

First input voltage $V_{i1}$ and second input voltage $V_{i2}$ may be applied to transistors Q1 and Q2, respectively, in order to determine which signal has a higher potential. Circuit 10 will be able to complete this function with a small error only when $V_{id}$ is more than $4V_t$. When $V_{i1}$ is $4V_t$ more than $V_{i2}$, second emitter current $I_{e2}$ will be negligible since transistor Q2 will be off. Consequently, output voltage $V_{out(10)}$ will have the same value as $V_{i1}$ plus an offset voltage due to the base-emitter voltage drop $V_{be1}$ in transistor Q1.

Because the emitter current depends on $V_{id}$, however, circuit 10 has limitations in performing this function. When $V_{i1}$ is within $4V_t$ of $V_{i2}$, second emitter current $I_{e2}$ will not be negligible since transistor Q2 will not be completely off. Thus, first emitter current $I_{e1}$ will be decreased when $V_{i1}$ is within $4V_t$ of $V_i$ by the amount of emitter current $I_{e2}$ flowing through transistor Q2. Consequently, the quantities $(V_{i1}-V_{be1})$ and $(V_{i2}-V_{be2})$ from EQUATION 10 will decrease when first and second input voltages $V_{i1}$ and $V_{i2}$ are within $4V_t$ of each other. Output voltage $V_{out(10)}$ will have an error because the base-emitter voltage drop $V_{be1}$ in transistor Q1 is reduced. The base-emitter voltage drop $V_{be1}$ in transistor Q1 is reduced because the first emitter current $I_{e1}$ is reduced. Error in this range is a limitation in circuit 10.

Figure 3:
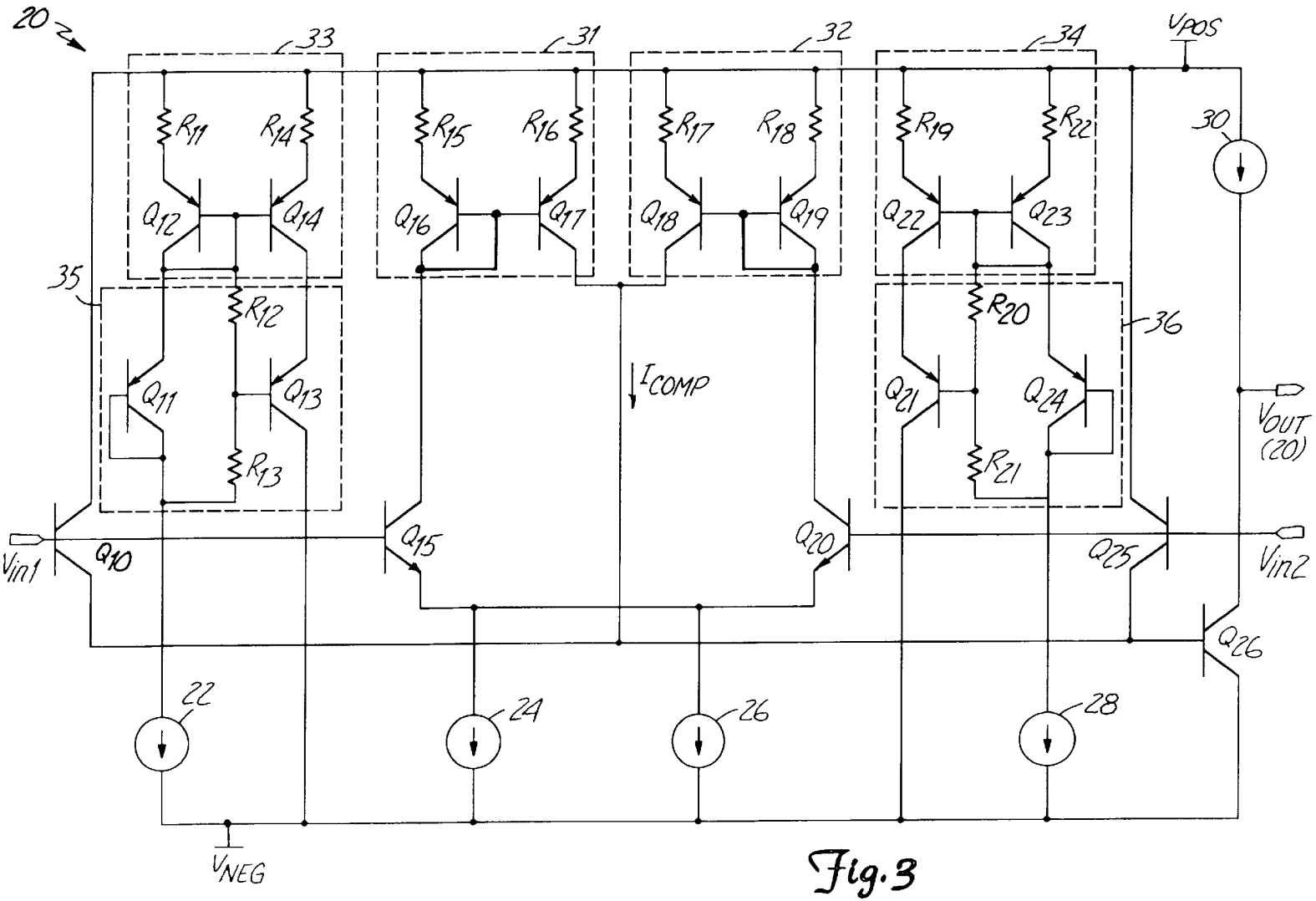
FIG. 3 is a circuit diagram of a maximum function schematic in accordance with the present invention

FIG. 3 is a schematic diagram of circuit 20 of the present invention, which overcomes limitations in the prior art to perform a maximum function. Circuit 20 includes transistors Q10–Q26, resistors R11–R22, and current sources 22, 24, 26, 28, and 30. Transistors Q10, Q15, Q20, and Q25 are NPN transistors with a base, an emitter, and a collector. Transistors Q11–Q14, Q16–Q19, Q21–Q24, and Q26 are each PNP transistors with a base, an emitter, and a collector.

Transistors Q10 and Q25 form an emitter-coupled pair, each having their emitters coupled together. Current source 26 is coupled between the emitters of transistors Q10 and Q25 to negative supply voltage $V_{neg}$. First input signal $V_{in1}$ is applied the base of transistor Q10, while second input signal $V_{in2}$ is applied the base of transistor Q25. The collectors of transistors Q10 and Q25 are coupled to positive supply voltage $V_{pos}$.

Transistors Q15 and Q20 form a second emitter-coupled pair, the second pair having their emitters coupled together. Current source 24 is coupled between the emitters of transistors Q15 and Q20 to negative supply voltage $V_{neg}$. First input signal $V_{in1}$ is coupled to the base of transistor Q15, while second input signal $V_{in2}$ is coupled to the base of transistor Q20. The collector of transistor Q15 is coupled to first inner current mirror 31 and the collector if transistor Q20 is coupled to second inner current mirror 32.

First inner current mirror 31 includes transistors Q16 and Q17, and resistors R15 and R16. The collector of transistor Q16 is coupled to the collector of transistor Q15 and to the base if transistor Q16. The emitter of transistor Q16 is coupled to resistor R15, which in turn is coupled to positive supply voltage $V_{pos}$. The base of transistor Q16 is coupled to the base of transistor Q17. The emitter of transistor Q17 is coupled to resistor R16, which in turn is coupled to positive supply voltage $V_{pos}$. The collector of transistor Q17 is then coupled between the emitters of transistors Q10 and Q25.

Second inner current mirror 32 includes transistors Q18 and Q19, and resistors R17 and R18. The collector of transistor Q19 is coupled to the collector of transistor Q20 and to the base if transistor Q19. The emitter of transistor Q19 is coupled to resistor R18, which in turn is coupled to positive supply voltage $V_{pos}$. The base of transistor Q19 is coupled to the base of transistor Q18. The emitter of transistor Q18 is coupled to resistor R17, which in turn is coupled to positive supply voltage $V_{pos}$. The collector of transistor Q18 is then coupled between the emitters of transistors Q10 and Q25.

First inner current mirror 31 is coupled to first outer current mirror 33 and second inner current mirror 32 is coupled to second outer current mirror 34.

First outer current mirror 33 includes transistors Q12 and Q14, and resistors R11 and R14. The collector of transistor Q14 is coupled to the collectors of transistors Q16 and Q15. The emitter of transistor Q14 is coupled to resistor R14, which in turn is coupled to positive supply voltage $V_{pos}$. The base of transistor Q14 is coupled to the base of transistor Q12. The emitter of transistor Q12 is coupled to resistor R11, which in turn is coupled to positive supply voltage $V_{pos}$. The collector of transistor Q12 is coupled to its base.

Second outer current mirror 34 includes transistors Q22 and Q23, and resistors R19 and R22. The collector of transistor Q22 is coupled to the collectors of transistors Q19 and Q20. The emitter of transistor Q22 is coupled to resistor R19, which in turn is coupled to positive supply voltage $V_{pos}$. The base of transistor Q22 is coupled to the base of transistor Q23. The emitter of transistor Q23 is coupled to resistor R22, which in turn is coupled to positive supply voltage $V_{pos}$. The collector of transistor Q23 is coupled to its base.

First outer current mirror 33 is coupled to first clamping circuit 35 and second outer current mirror 34 is coupled to second clamping circuit 36.

First clamping circuit 35 includes transistors Q11 and Q13, and resistors R12 and R13. The emitter of transistor Q11 is coupled to the collector of transistor Q12 and to resistor R12. The base of transistor Q11 is coupled to its collector, to resistor R13, and to current source 22. Current source 22 is coupled to negative supply voltage $V_{neg}$. Resistor R13 is coupled to resistor R12, and the base of transistor Q13 is coupled between resistors R12 and R13. The emitter of transistor Q13 is coupled to the collectors of transistors Q14, Q15, and Q16. The collector of transistor Q13 is coupled to negative supply voltage $V_{neg}$.

Second clamping circuit 36 includes transistors Q21 and Q24, and resistors R20 and R21. The emitter of transistor Q24 is coupled to the collector of transistor Q23 and to resistor R20. The base of transistor Q24 is coupled to its collector, to resistor R21, and to current source 28. Current source 28 is coupled to negative supply voltage $V_{neg}$. Resistor R21 is coupled to resistor R20, and the base of transistor Q21 is coupled between resistors R20 and R21. The emitter of transistor Q21 is coupled to the collectors of transistors Q19, Q20, and Q22. The collector of transistor Q21 is coupled to negative supply voltage $V_{neg}$.

Output signal $V_{out(20)}$ of circuit 20 is taken between current source 30 and the emitter of transistor Q26. Current source 30 is also coupled to positive supply voltage $V_{pos}$. The base of transistor Q26 is coupled between the emitters of transistors Q10 and Q25. The collector of transistor Q25 supplied to negative supply voltage $V_{neg}$.

In operation, circuit 20 may be used to receive first and second input voltages $V_{in1}$ and $V_{in2}$, and to produce output voltage $V_{out(20)}$ that is equal to the greater of $V_{in1}$ and $V_{in2}$ plus a small offset voltage. In circuit 20, there is no error in output voltage $V_{out(20)}$, because the emitter current is kept constant in the emitter of the emitter coupled pair of transistors Q10 and Q25 that has the higher voltage applied to its base. Even for small differences between first and second input voltages $V_{in1}$ and $V_{in2}$, the emitter current in the emitter of the transistor with the higher base voltage will be constant. Since the emitter current does not decrease for small differences between first and second input voltages $V_{in1}$ and $V_{in2}$, output voltage $V_{out(20)}$ will not increase when first and second input voltages $V_{in1}$ and $V_{in}$ are close in potential. Consequently, circuit 20 produces the following result:

$$V_{out(20)}=\max\,[(V_{in1}, V_{in2})+V_{offset} \qquad \text{(EQUATION 13)}$$

Referring to FIG. 3, current through current sources 22, 24, 26, 28 and 30 is constant. Current through current source 22 is the same as that through current source 28. Similarly, current through current source 24 is the same as that through current source 26. Current through current sources 22 and 28 is one half of the current through current sources 24 and 26.

When $V_{in1}$ is much greater than $V_{in2}$, on the order of $10V_t$ or more for example, transistors Q10 and Q15 are on, while transistors Q20 and Q25 are off. Thus, essentially all of the current through current source 24 is flowing through transistor Q15. Current through current source 22 flows into first outer current mirror 33. First outer current mirror 33 is a 1:1 current mirror such that current out of current mirror 33 is the same as the current through current source 22. Thus, the current out of first outer current mirror 33 is one half the amount of current flowing through transistor Q15, that is, one half of the current through current source 24. In this way, the current out of first outer current mirror 33 then subtracts from the current through transistor Q15, and the remaining half of the current through transistor Q15 flows into first inner current mirror 31. Because first inner current mirror 31 is also a 1:1 mirror, the output of first inner current mirror 31 equals one half of the current through current sources 24 and 26.

Since transistors Q20 and Q25 are off when first input voltage $V_{in1}$ is much greater than $V_{in2}$, essentially none of the current through current source 24 is flowing through transistor Q20. Current through current source 28 flows into second outer current mirror 34. Second outer current mirror 34 is a 1:1 current mirror such that current out of second current mirror 34 is the same as the current through current source 28. Since transistor Q20 is off, transistor Q21 sinks the current from second outer current mirror 34 and keeps it from saturating. Consequently, no current flows into second inner current mirror 32, which is also a 1:1 mirror.

The outputs of first and second inner mirrors 31 and 32 combine to form compensation current $I_{comp}$ for circuit 20. As indicated, when first input voltage $V_{in1}$ is much greater than second input voltage $V_{in2}$, the output of first inner current mirror 31 is one half of the current from current source 26 and the output from second inner current mirror 32 is zero. Consequently, compensation current $I_{comp}$ is one half of the current from current source 26 under these circumstances. Since transistor Q25 is off, all of the current from current source 26 is flowing through transistor Q10. Compensation current $I_{comp}$ then subtracts from the current from current source 26 leaving current one half the value of current source 26 flowing through transistor Q10. In this way, emitter current $I_{e10}$ in transistor Q10 is one half of the current through current source 26 when first input voltage $V_{in1}$ is much greater than second input voltage $V_{in2}$.

When first input voltage $V_{in1}$ is equal to second input voltage $V_{in2}$, transistors Q10, Q15, Q20, and Q25 are all on. Thus, the current from current source 24 is split equally through transistors Q15 and Q20. Again, the current through current source 22, which is one half the current through current source 24, flows into first outer current mirror 33. Since first outer current mirror 33 is a 1:1 mirror, the output of first outer current mirror 33 is also one half the current through current source 24. Consequently, under this condition of balanced inputs, the current out of current mirror 33 equals the current through transistor Q15 and thus the net current into first inner current mirror 31 is zero. Since first inner current mirror 31 is also a 1:1 mirror, the current out of first inner current mirror 31 is zero.

Similarly, the current through current source 28, which is one half the current through current source 24, flows into second outer current mirror 34. Since second outer current mirror 34 is a 1:1 mirror, the output of the second outer current mirror 34 is also one half the current through current source 24. Consequently, under this condition of balanced inputs, the current out of second outer current mirror 34 equals the current through transistor Q20 and thus the net current into second inner current mirror 32 is zero. Since second inner current mirror 32 is also a 1:1 mirror, the current out of second inner current mirror 32 is zero.

Summing the currents out of first and second inner current mirrors 31 and 32 gives a total compensation current $I_{comp}$ of zero. Consequently, emitter current $I_{e10}$ in transistor Q10 is one half of the current through current source 26 when first input voltage $V_{in1}$ is equal to second input voltage $V_{in2}$. In this way, emitter current $I_{e10}$ in transistor Q10 is the same for when $V_{in1}$ is much greater than $V_{in2}$ as it is for when $V_{in1}$ is equal to $V_{in2}$.

When first input voltage $V_{in1}$ is larger than second input voltage $V_{in2}$, but within several $V_t$ of second input voltage $V_{in2}$, transistors Q10 and Q15 are on, but transistors Q20 and Q25 also begin to turn on. Thus, some of the current from current source 26 is split away from transistor Q10 into transistor Q25. By generating the variable compensation current $I_{comp}$ based upon first and second input voltages $V_{in1}$ and $V_{in2}$, however, circuit 20 keeps emitter current $I_{e10}$ in transistor Q10 constant, regardless of how close the two input voltages are to one another.

In fact, by generating the variable compensation current $I_{comp}$ based upon first and second input voltages $V_{in1}$ and $V_{in2}$, circuit 20 keeps the current density in the transistor of the emitter-connected pair with the higher input voltage constant, regardless of how close the two input voltages are to one another.

EQUATION 13 may be expanded by summing voltages in two alternative loops, one containing transistors Q10 and Q26 and another containing transistors Q25 and Q26:

$$V_{out(20)}=\max\left[(V_{in1}-V_{be10}),\ (V_{in2}-V_{be25})\right]+V_{be26} \quad \text{(EQUATION 14)}$$

where $V_{be(Q26)}$ is the voltage drop across the base-emitter junction of output transistor Q26.

Figure 4:
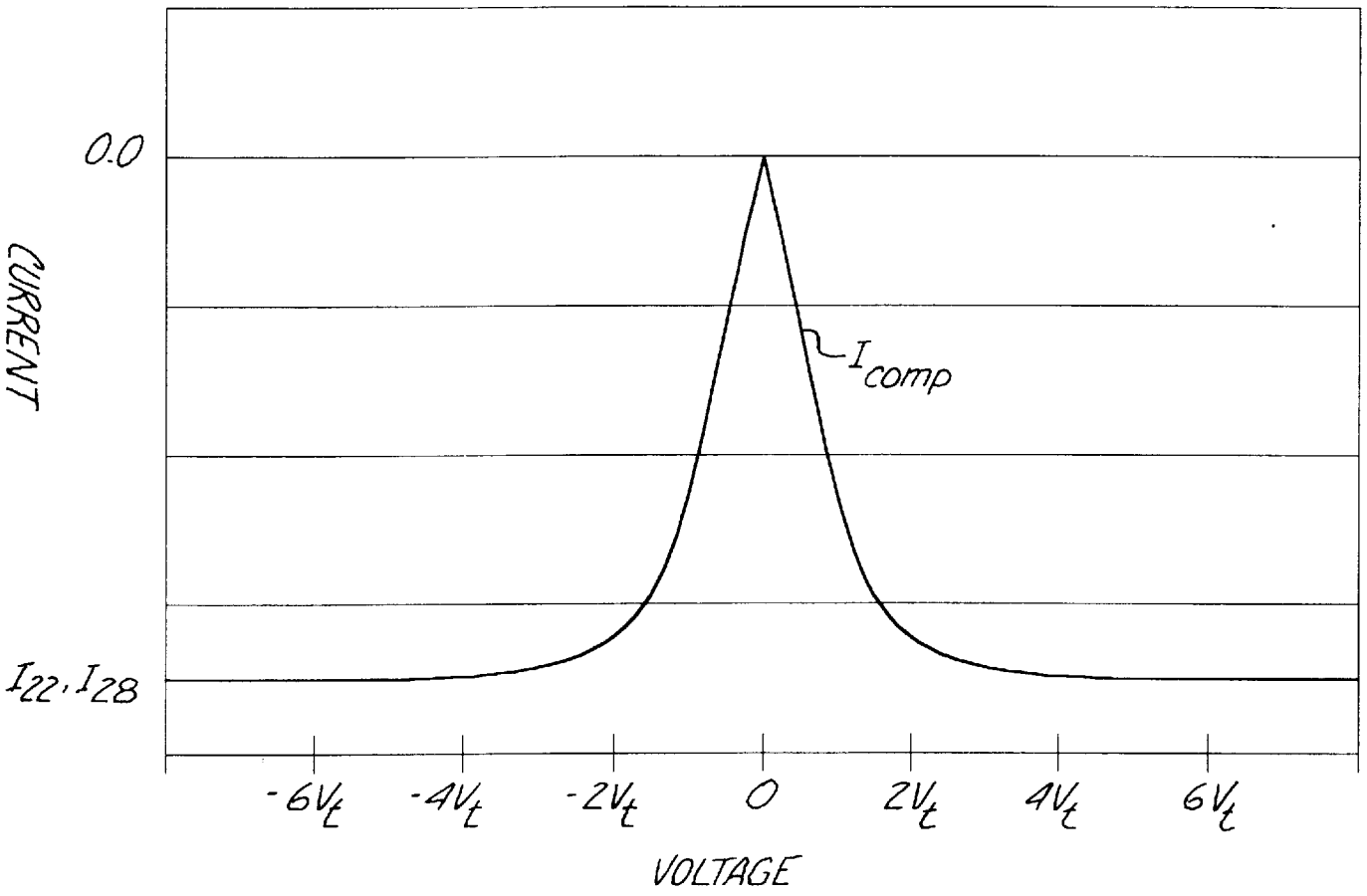
FIG. 4 is a graph relating current to a voltage differential of two input signals

FIG. 4 is a graph relating compensation current $I_{comp}$ in circuit 20 to the difference between first and second input voltages $V_{in2}$ and $V_{in1}$, defined as $V_{diff}$. Compensation current $I_{comp}$ is at a constant negative value for values of $V_{diff}$ greater than $4V_t$ or less than $-4V_t$. In circuit 20, compensation current $I_{comp}$ is the value of current $I_{22}$ and $I_{28}$ through current sources 22 and 28. As first and second input voltages $V_{in2}$ and $V_{in1}$ get closer together, compensation current $I_{comp}$ gradually increases to zero. When first and second input voltages $V_{in2}$ and $V_{in1}$ are equal, compensation current $I_{comp}$ is zero. In this way, compensation current $I_{comp}$ keeps the emitter current constant in the transistor with the higher voltage applied to its base.

Figure 5:
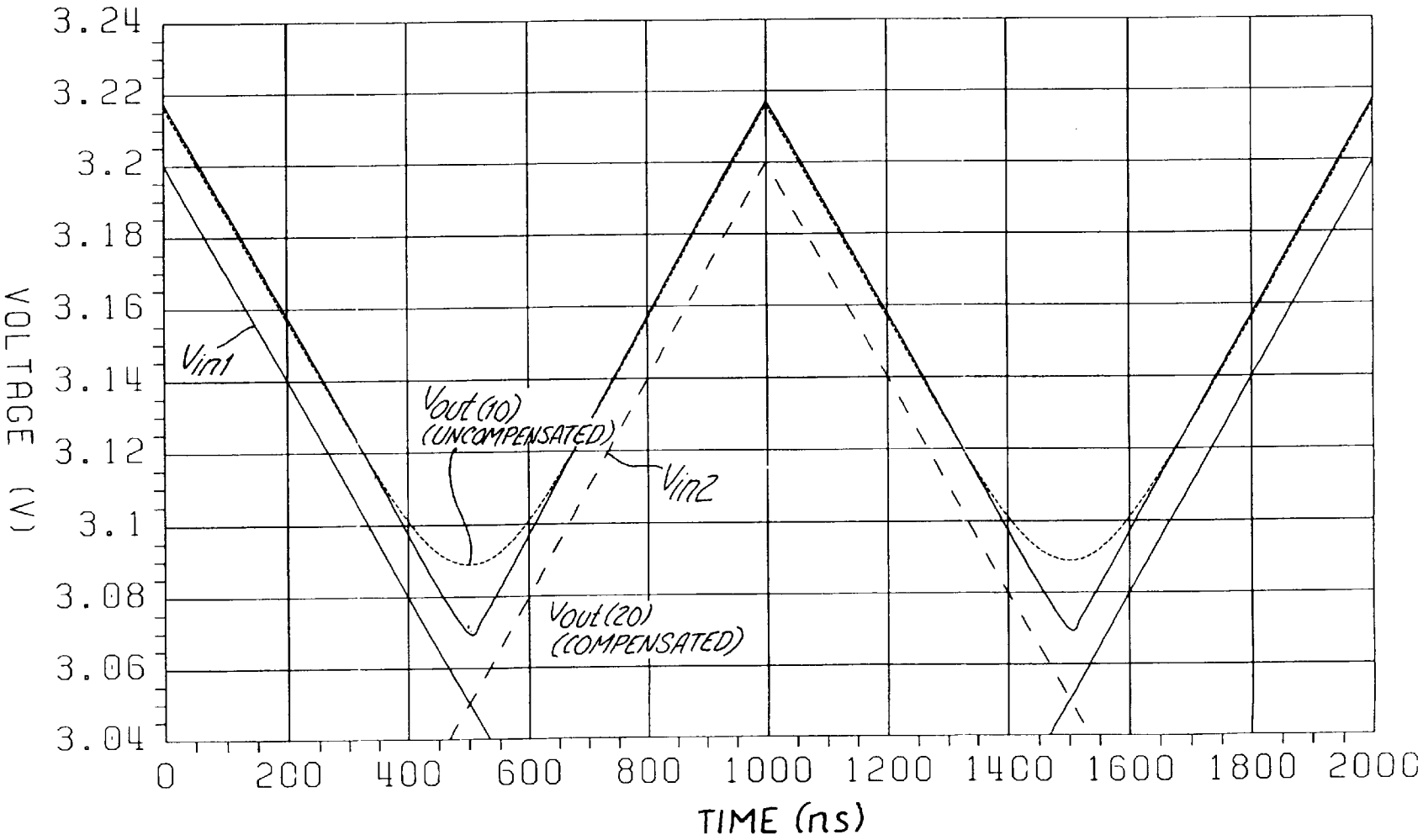
FIG. 5 is a graph relating input and output voltages to time

FIG. 5 is a graph showing first and second input voltages $V_{in1}$ and $V_{in2}$, uncompensated output voltage $V_{out(10)}$(from circuit 10), and compensated output voltage $V_{out(20)}$(from circuit 20) over time. Line $V_{in1}$ represents first input voltage $V_{in1}$ over time. Line $V_{in2}$ represents second input voltage $V_{in2}$ over time. Line $V_{out(10)}$ relates uncompensated output voltage $V_{out(10)}$ from circuit 10 of the prior art to time. Line $V_{out(20)}$ relates compensated output voltage $V_{out(20)}$ from circuit 20 of the present invention to time. As seen from FIG. 5, both line $V_{out(10)}$ and $V_{out(20)}$ provide a good approximation of the larger of the input voltages plus an offset voltage when there is a large difference between first and second voltages $V_{in1}$ and $V_{in2}$. As first and second voltages $V_{in1}$ and $V_{in2}$ approach each other, however, output voltage $V_{out(20)}$ from circuit 20 provides a much improved representation of the larger of the input voltages plus an offset voltage over $V_{out(10)}$ from circuit 10.

Figure 6:
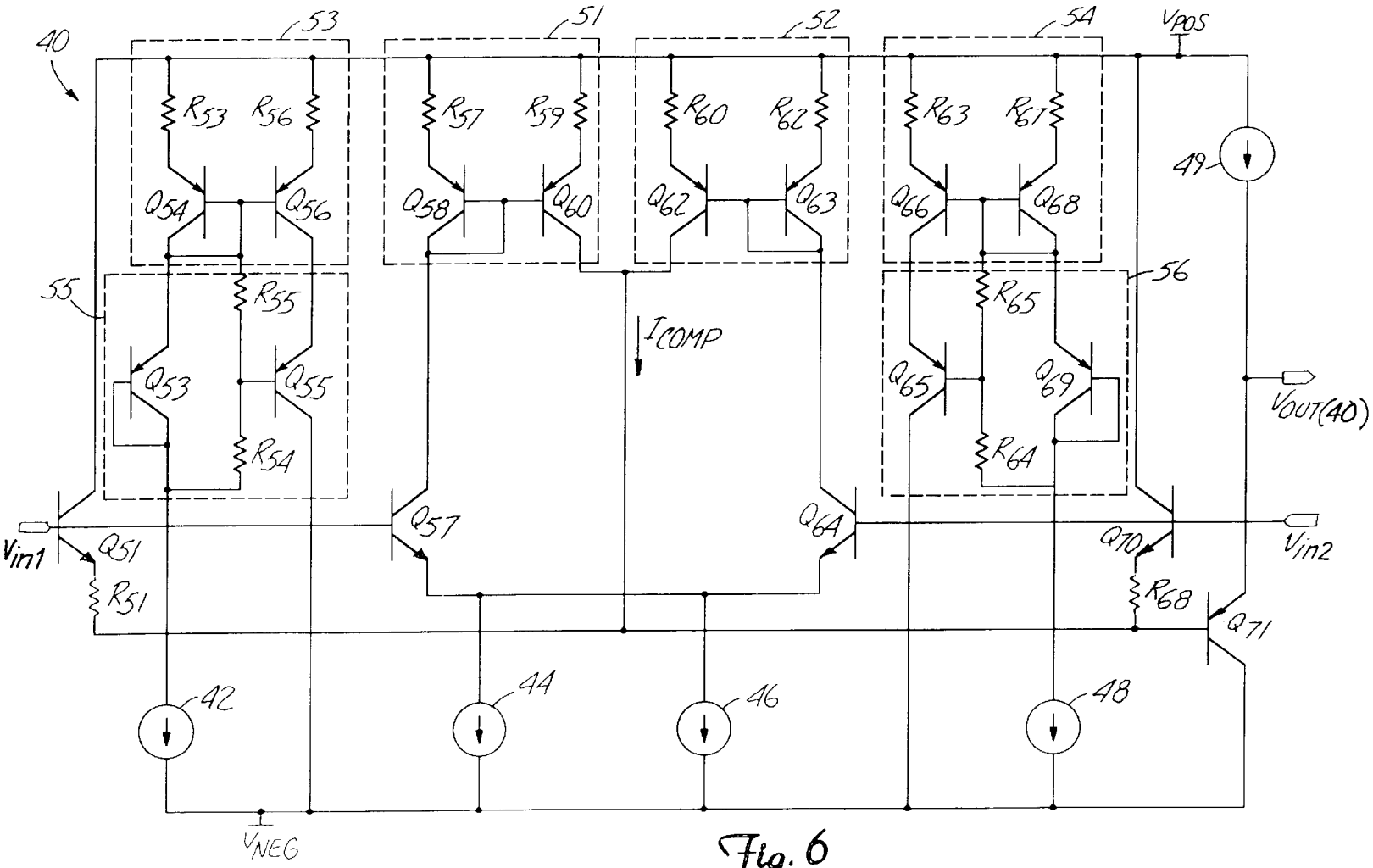
FIG. 6 is a circuit diagram of an alternative embodiment of a maximum function schematic in accordance with the present invention

FIG. 6 shows circuit 40, which is an alternative embodiment of a maximum function schematic in accordance with the present invention. Circuit 40 includes transistors Q51, Q53–Q58, Q60, Q62–Q66, and Q68–Q71 and resistors R51, R53–R57, R59–R60, R62–R65, and R67–R68. Transistors Q51, Q57, Q64, and Q70 are NPN transistors with a base, an emitter, and a collector. The remaining transistors, Q53–Q56, Q58, Q60, Q62–Q63, Q65 Q66, Q68–Q69, and Q71 are each PNP transistors with a base, an emitter, and a collector.

Transistors Q51 and Q70 form an emitter-coupled pair, each having their emitters coupled through resistors R51 and R68. Current source 46 is coupled between resistors R51 and R68 to negative supply voltage $V_{neg}$. First input signal $V_{in1}$ is applied the base of transistor Q51, while second input signal $V_{in2}$ is applied the base of transistor Q70. The collectors of transistors Q51 and Q70 are coupled to positive supply voltage $V_{pos}$.

Transistors Q57 and Q64 form a second emitter-coupled pair, the second pair having their emitters coupled together. Current source 44 is coupled between the emitters of transistors Q57 and Q64 to negative supply voltage $V_{neg}$. First input signal $V_{in1}$ is coupled to the base of transistor Q57, while second input signal $V_{in2}$ is coupled to the base of transistor Q64. The collector of transistor Q57 is coupled to first inner current mirror 51 and the collector of transistor Q64 is coupled to second inner current mirror 52.

First inner current mirror 51 includes transistors Q58 and Q60, and resistors R57 and R59. The collector of transistor Q58 is coupled to the collector of transistor Q57 and to the base of transistor Q58. The emitter of transistor Q58 is coupled to resistor R57, which in turn is coupled to positive supply voltage $V_{pos}$. The base of transistor Q58 is coupled to the base of transistor Q60. The emitter of transistor Q60 is coupled to resistor R59, which in turn is coupled to positive supply voltage $V_{pos}$. The collector of transistor Q60 is then coupled between resistors R51 and R68.

Second inner current mirror 52 includes transistors Q62 and Q63, and resistors R60 and R62. The collector of transistor Q63 is coupled to the collector of transistor Q64 and to the base if transistor Q63. The emitter of transistor Q63 is coupled to resistor R62, which in turn is coupled to positive supply voltage $V_{pos}$. The base of transistor Q63 is coupled to the base of transistor Q62. The emitter of transistor Q62 is coupled to resistor R60, which in turn is coupled to positive supply voltage $V_{pos}$. The collector of transistor Q62 is then coupled between resistors R51 and R68.

First inner current mirror 51 is coupled to first outer current mirror 53 and second inner current mirror 52 is coupled to second outer current mirror 54.

First outer current mirror 53 includes transistors Q54 and Q56, and resistors R53 and R56. The collector of transistor Q56 is coupled to the collectors of transistors Q58 and Q57. The emitter of transistor Q56 is coupled to resistor R56, which in turn is coupled to positive supply voltage $V_{pos}$. The base of transistor Q56 is coupled to the base of transistor Q54. The emitter of transistor Q54 is coupled to resistor R53, which in turn is coupled to positive supply voltage $V_{pos}$. The collector of transistor Q54 is coupled to its base.

Second outer current mirror 54 includes transistors Q66 and Q68, and resistors R63 and R67. The collector of transistor Q66 is coupled to the collectors of transistors Q63 and Q64. The emitter of transistor Q66 is coupled to resistor R63, which in turn is coupled to positive supply voltage $V_{pos}$. The base of transistor Q66 is coupled to the base of transistor Q68. The emitter of transistor Q68 is coupled to resistor R67, which in turn is coupled to positive supply voltage $V_{pos}$. The collector of transistor Q68 is coupled to its base.

First outer current mirror 53 is coupled to first clamping circuit 55 and second outer current mirror 54 is coupled to second clamping circuit 56.

First clamping circuit 55 includes transistors Q53 and Q55, and resistors R54 and R55. The emitter of transistor Q53 is coupled to the collector of transistor Q54 and to resistor R55. The base of transistor Q53 is coupled to its collector, to resistor R54, and to current source 42. Current source 42 is coupled to negative supply voltage $V_{neg}$. Resistor R54 is coupled to resistor R55, and the base of transistor Q55 is coupled between resistors R54 and R55. The emitter of transistor Q55 is coupled to the collectors of transistors Q56, Q57, and Q58. The collector of transistor Q55 is coupled to negative supply voltage $V_{neg}$.

Second clamping circuit 56 includes transistors Q65 and Q69, and resistors R64 and R65. The emitter of transistor Q69 is coupled to the collector of transistor Q68 and to resistor R65. The base of transistor Q69 is coupled to its collector, to resistor R64 and to current source 48. Current source 48 is coupled to negative supply voltage $V_{neg}$. Resistor R64 is coupled to resistor R65, and the base of transistor Q65 is coupled between resistors R64 and R65. The emitter of transistor Q65 is coupled to the collectors of transistors Q63, Q64, and Q66. The collector of transistor Q65 is coupled to negative supply voltage $V_{neg}$.

Output signal $V_{out(40)}$ is taken between current source 49 and the emitter of transistor Q71. Current source 49 is coupled to positive supply voltage $V_{pos}$. The base of transistor Q71 is coupled between resistors R51 and R68. The collector of transistor Q71 is coupled to negative supply voltage $V_{neg}$.

In operation, circuit 40 is used to receive first and second input voltages $V_{in1}$ and $V_{in2}$, and to produce an output voltage $V_{out(40)}$ that is equal to the greater of first and second input voltages $V_{in1}$ and $V_{in2}$ plus a small offset voltage. In circuit 40, there is no error in output voltage $V_{out(40)}$, because the emitter current is constant in the transistor (Q51 or Q70) with the higher voltage applied to its base. Circuit 40 generates variable compensation current $I_{comp}$ based upon first and second input voltages $V_{in1}$ and $V_{in2}$, in much the same way as circuit 20 such that emitter current $I_{e51}$ in transistor Q51 or emitter current $I_{e70}$ in transistor Q70 is kept constant in whichever transistor has the higher base voltage, regardless of how close the two input voltages are to one another.

Summing voltages in two alternative loops, one containing transistor Q51, resistor R51, and transistor Q71, and another containing transistor Q70, resistor R68, and transistor Q71, circuit 40 provides:

$$V_{out(40)}=\max\left[(V_{in1}-V_{be51}-V_{(R51)}),\ (V_{in2}-V_{be70}-V_{(R68)})\right]+V_{be71} \quad \text{(EQUATION 15)}$$

where $V_{be51}$, $V_{be70}$, and $V_{be71}$ are the voltage drops across the base-emitter junctions in transistors Q51, Q70 and Q71, and where $V_{(R51)}$ and $V_{(R68)}$ are the voltage drops across resistors R51 and R68.

In a preferred embodiment of circuit 40, current sources 42 and 48 include a reference voltage, a transistor, and a resistor such that 65 microamps are flowing through sources 42 and 48. Similarly, current sources 44 and 46 include a reference voltage, a transistor, and a resistor such that 130 microamps are flowing through sources 44 and 46. In this embodiment, 65 microamps flow into first and second outer current mirrors 53 and 54.

When $V_{in1}$ is much greater than $V_{in2}$, on the order of $10V_t$ or more for example, transistors Q51 and Q57 are on, while transistors Q64 and Q70 are off. Thus, 130 microamps of current through current source 44 is flowing through transistor Q57. Since first outer current mirror 53 is a 1:1 current mirror, 65 microamps flow out of current mirror 53. The 65 microamps of current out of first outer current mirror 53 then subtracts from the 130 microamps of current through transistor Q57 such that the remaining 65 microamps of current through transistor Q57 flows into first inner current mirror 51. Because first inner current mirror 51 is also a 1:1 mirror, the output of first inner current is also 65 microamps.

Since transistors Q64 and Q70 are off when first input voltage $V_{in1}$ is much greater than $V_{in2}$, none of the current through current source 44 is flowing through transistor Q64. Since second outer current mirror 54 is a 1:1 current mirror, 65 microamps flow out of second current mirror 54. Since transistor Q64 is off, transistor Q65 sinks the 65 microamps of current from second outer current mirror 54 and keeps it from saturating. Consequently, no current flows into or out of second inner current mirror 52, which is also a 1:1 mirror.

The outputs of first and second inner mirrors 51 and 52 combine to form compensation current $I_{comp}$ for circuit 40. As indicated, when first input voltage $V_{in1}$ is much greater than second input voltage $V_{in2}$, the output of first inner current mirror 51 is 65 microamps and the output from second inner current mirror 52 is zero. Consequently, compensation current $I_{comp}$ is 65 microamps when first input voltage $V_{in1}$ is much greater than second input voltage $V_{in2}$. Since transistor Q70 is off, the 130 microamps of current through current source 46 is flowing through transistor Q51. The 65 microamps of compensation current $I_{comp}$ then subtracts from the 130 microamps of current through transistor 51, leaving a total of 65 microamps of current flowing through transistor Q51. In this way, emitter current $I_{e51}$ in transistor Q51 is 65 microamps when first input voltage $V_{in1}$ is much greater than second input voltage $V_{in2}$.

When first input voltage $V_{in1}$ is equal to second input voltage $V_{in2}$, transistors Q51, Q57, Q64, and Q70 are all on. Thus, the 130 microamps of current through current source 44 is split equally through transistors Q57 and Q64, such that 65 microamps of current flow through both transistors Q57 and Q64. Since first outer current mirror 53 is a 1:1 mirror, 65 microamps of current flows out of first outer current mirror 53. The 65 microamps of current out of current mirror 53 equals the current through transistor Q57, and thus the net current into first inner current mirror 51 is zero. Since first inner current mirror 51 is also a 1:1 mirror, the current out of first inner current mirror 51 is zero.

Similarly, since second outer current mirror 54 is a 1:1 mirror, 65 microamps of current flows out of second outer current mirror 54. The 65 microamps of current out of current mirror 54 equals the current through transistor Q64, and thus the net current into second inner current mirror 52 is zero. Since second inner current mirror 52 is also a 1:1 mirror, the current out of second inner current mirror 52 is zero.

Summing the currents out of first and second inner current mirrors 51 and 52 gives a total compensation current $I_{comp}$ of zero. Since transistors Q51 and Q70 split the 130 microamps of current through current source 46, emitter current $I_{e51}$ in transistor Q51 is 65 microamps when first input voltage $V_{in1}$ is equal to second input voltage $V_{in2}$. In this way, emitter current $I_{e51}$ in transistor Q51 is the same for when $V_{in1}$ is much greater than $V_{in2}$ as it is for when $V_{in1}$ is equal to $V_{in2}$.

When first input voltage $V_{in1}$ is larger than second input voltage $V_{in2}$, but within several $V_t$ of second input voltage $V_{in2}$, transistors Q51 and Q57 are on, but transistors Q64 and Q70 also begin to turn on. Thus, some of the 130 microamps of current through current source 46 is split away from transistor Q51 into transistor Q70. However, circuit 40 generates variable compensation current $I_{comp}$ based upon first and second input voltages $V_{in1}$ and $V_{in2}$. In this situation, compensation current $I_{comp}$ subtracts from the portion of the 130 microamps that is not split away into transistor Q70 such that emitter current $I_{e51}$ in transistor Q51 is kept at a constant 65 microamps. In fact, as long as first input voltage $V_{in1}$ is greater than second input voltage $V_{in2}$, compensation current $I_{comp}$ subtracts from the portion of the 130 microamps from current source 46 through transistor Q51 such that emitter current $I_{e51}$ in transistor Q51 is kept at a constant 65 microamps, regardless of how close the two input voltages are to one another.

Similarly, when second input voltage $V_{in2}$ is greater than first input voltage $V_{in1}$, compensation current $I_{comp}$ subtracts from the portion of the 130 microamps from current source 46 through transistor Q70 such that emitter current $I_{e70}$ in transistor Q70 is kept at a constant 65 microamps, regardless of how close the two input voltages are to one another.

Resistors R51 and R68 in circuit 40 cause the emitter-connected pair of transistors Q57 and Q64 to switch current from side to side faster than emitter-connected pair of transistors Q51 and Q70. This is true since the current in a differential pair switches from side to side as an exponential function of the voltage difference across the bases of the differential pair. This improves the performance of circuit 40. The value of resistors R51 and R68 can be tuned to minimize the error in the compensation circuit so that the appropriate amount of compensation current is generated.

Figure 7:
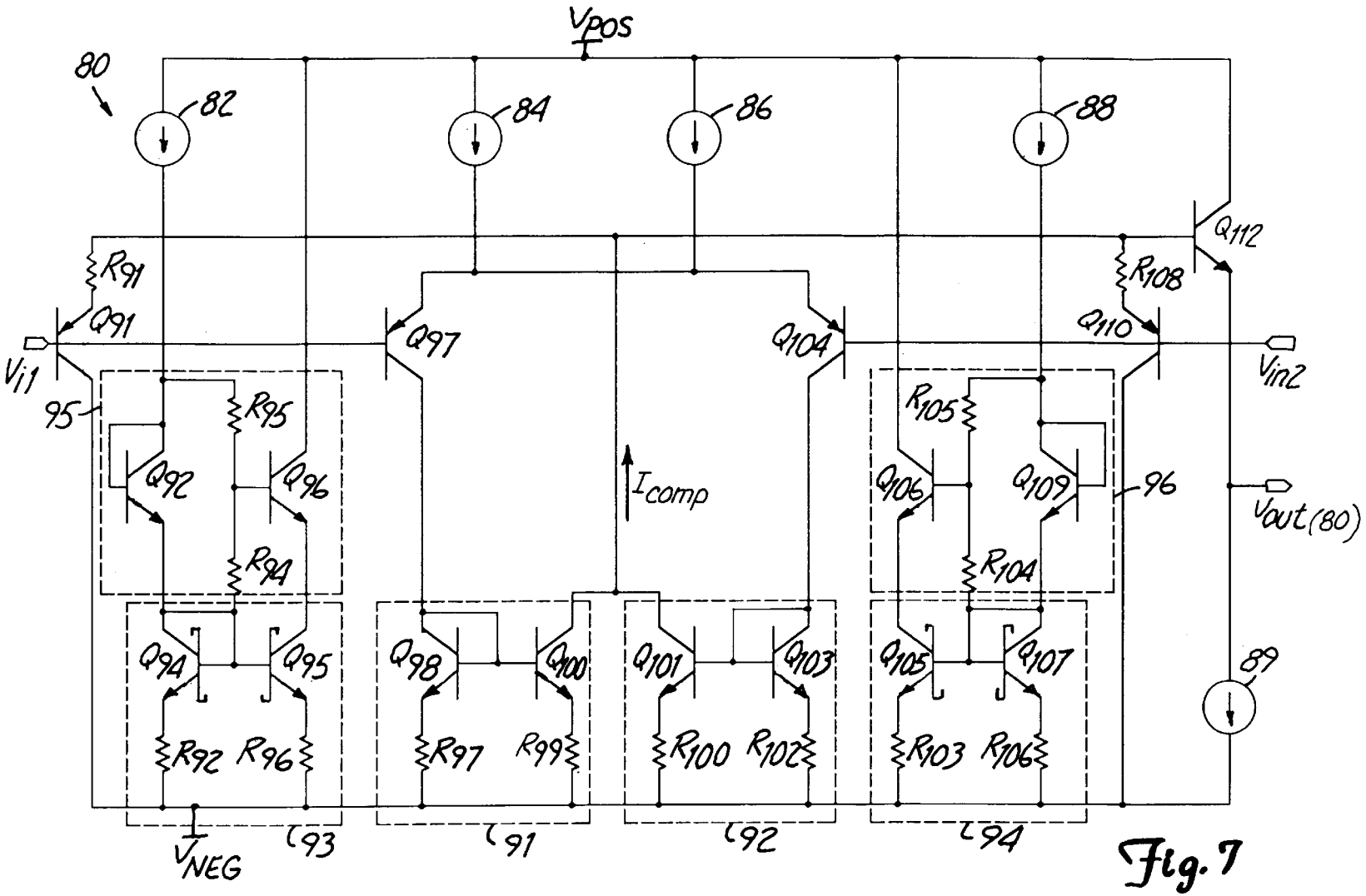
FIG. 7 is a circuit diagram of a minimum function schematic in accordance with the present invention

FIG. 7 shows circuit 80, which is an alternative embodiment of a minimum function schematic in accordance with the present invention. Circuit 80 includes transistors Q91–Q92, Q94–Q98, Q100–Q101, Q103–Q107, Q109–Q110, and Q112 and resistors R91–R92, R94–R97, R99–R100, R102–R106, and R108. Transistors Q91, Q97, Q104, and Q110 are PNP transistors with a base, an emitter, and a collector. The remaining transistors, Q92, Q94–Q96, Q98, Q100–Q101, Q103, Q105–Q107, Q109, and Q112 are each NPN transistors with a base, an emitter, and a collector.

Transistors Q91 and Q110 form an emitter-coupled pair, each having their emitters coupled through resistors R91 and R108. Current source 86 is coupled between resistors R91 and R108 to positive supply voltage $V_{pos}$. First input signal $V_{in1}$ is applied the base of transistor Q91, while second input signal $V_{in2}$ is applied the base of transistor Q110. The collectors of transistors Q91 and Q110 are coupled to negative supply voltage $V_{neg}$.

Transistors Q97 and Q104 form a second emitter-coupled pair, the second pair having their emitters coupled together. Current source 84 is coupled between the emitters of transistors Q97 and Q104 to positive supply voltage $V_{pos}$. First input signal $V_{in1}$ is coupled to the base of transistor Q97, while second input signal $V_{in2}$ is coupled to the base of transistor Q104. The collector of transistor Q97 is coupled to first inner current mirror 91 and the collector of transistor Q104 is coupled to second inner current mirror 92.

First inner current mirror 91 includes transistor Q98 and Q100, and resistors R97 and R99. The collector of transistor Q98 is coupled to the collector of transistor Q97 and to the base of transistor Q98. The emitter of transistor Q98 is coupled to resistor R97, which in turn is coupled to negative supply voltage $V_{neg}$. The base of transistor Q98 is coupled to the base of transistor Q100. The emitter of transistor Q100 is coupled to resistor R99, which in turn is coupled to negative supply voltage $V_{neg}$. The collector of transistor Q100 is then coupled between resistors R91 and R108.

Second inner current mirror 92 includes transistors Q101 and Q103, and resistors R100 and R102. The collector of transistor Q103 is coupled to the collector of transistor Q104 and to the base of transistor Q103. The emitter of transistor Q103 is coupled to resistor R102, which in turn is coupled to negative supply voltage $V_{neg}$. The base of transistor Q103 is coupled to the base of transistor Q101. The emitter of transistor Q101 is coupled to resistor R100, which in turn is coupled to negative supply voltage $V_{neg}$. The collector of transistor Q101 is then coupled between resistors R91 and R108.

First inner current mirror 91 is coupled to first outer current mirror 93 and second inner current mirror 92 is coupled to second outer current mirror 94.

First outer current mirror 93 includes transistors Q94 and Q95, and resistors R92 and R96. The collector of transistor Q95 is coupled to the collectors of transistors Q98 and Q97. The emitter of transistor Q95 is coupled to resistor R96, which in turn is coupled to negative supply voltage $V_{neg}$. The base of transistor Q95 is coupled to the base of transistor Q94. The emitter of transistor Q94 is coupled to resistor R92, which in turn is coupled to negative supply voltage $V_{neg}$. The collector of transistor Q94 is coupled to its base.

Second outer current mirror 94 includes transistors Q105 and Q107, and resistors R103 and R106. The collector of transistor Q105 is coupled to the collectors of transistor Q103 and Q104. The emitter of transistor Q105 is coupled to resistor R103, which in turn is coupled to negative supply voltage $V_{neg}$. The base of transistor Q105 is coupled to the base of transistor Q107. The emitter of transistor Q107 is coupled to resistor R106, which in turn is coupled to negative supply voltage $V_{neg}$. The collector of transistor Q107 is coupled to its base.

First outer current mirror 93 is coupled to first clamping circuit 95 and second outer current mirror 94 is coupled to second clamping circuit 96.

First clamping circuit 95 includes transistors Q92 and Q96, and resistors R94 and R95. The emitter of transistor Q92 is coupled to the collector of transistor Q94 and to resistor R94. The base of transistor Q92 is coupled to its collector, to resistor R95, and to current source 82. Current source 82 is coupled to positive supply voltage $V_{pos}$. Resistor R94 is coupled to resistor R95, and the base of transistor Q96 is coupled between resistors R94 and R95. The emitter of transistor Q96 is coupled to the collectors of transistors Q95, Q97, and Q98. The collector of transistor Q96 is coupled to positive supply voltage $V_{pos}$.

Second clamping circuit 96 includes transistors Q106 and Q109, and resistors R104 and R105. The emitter of transistor Q109 is coupled to the collector of transistor Q107 and to resistor R104. The base of transistor Q109 is coupled to its collector, to resistor R105 and to current source 88. Current source 88 is coupled to positive supply voltage $V_{pos}$. Resistor R104 is coupled to resistor R105, and the base of transistor Q106 is coupled between resistors R104 and R105. The emitter of transistor Q106 is coupled to the collectors of transistors Q103, Q104, and Q105. The collector of transistor Q106 is coupled to positive supply voltage $V_{pos}$.

Output signal $V_{out(80)}$ is taken between the emitter of transistor Q112 and current source 89. Current source 89 is coupled to negative supply voltage $V_{neg}$. The base of transistor Q112 is coupled between resistors R91 and R108. The collector of transistor Q112 is coupled to positive supply voltage $V_{pos}$.

In operation, circuit 80 is used to receive first and second input voltages $V_{in1}$ and $V_{in2}$, and to produce an output voltage $V_{out(80)}$ that is equal to the smaller of first and second input voltages $V_{in1}$ and $V_{in2}$ plus a small offset voltage. In circuit 80, there is a reduced error in output voltage $V_{out(80)}$, because the emitter current is constant in the transistor (Q91 or Q110) with the lower voltage applied to its base. Even for small differences between first and second input voltages $V_{in1}$ and $V_{in2}$, the transistor with the lower voltage applied at its base will have a constant emitter current. Because of this, output voltage $V_{out(80)}$ will not decrease when first and second input voltages $V_{in1}$ and $V_{in}$ are close in potential. Consequently, circuit 80 performs:

$$V_{out(80)}=\min(V_{in1}, V_{in2})+V_{offset} \quad \text{(EQUATION 16)}$$

Referring to FIG. 7, current through current sources 82, 84, 86, 88 and 89 is constant. Current through current source 82 is the same as that through current source 88. Similarly, current through current source 84 is the same as that through current source 86. Current through current sources 82 and 88 is one half of the current through current sources 84 and 86.

When $V_{in1}$ is much less than $V_{in2}$, on the order of $10V_t$ less for example, transistors Q91 and Q97 are on, while transistors Q104 and Q110 are off. Thus, essentially all of the current through current source 84 is flowing through transistor Q97. Current through current source 82 flows into first outer current mirror 93. First outer current mirror 93 is a 1:1 current mirror such that current out of current mirror 93 is the same as the current through current source 82. Thus, the current out of first outer current mirror 93 is one half the amount of current flowing through transistor Q97, that is, one half of the current through current source 84. In this way, the current out of first outer current mirror 93 then subtracts from the current through transistor Q97, and the remaining half of the current through transistor Q97 flows into first inner current mirror 91. Because first inner current mirror 91 is also a 1:1 mirror, the output of first inner current mirror 91 equals one half of the current through current sources 84 and 86.

Since transistors Q104 and Q110 are off when first input voltage $V_{in1}$ is much less than $V_{in2}$, essentially none of the current through current source 84 is flowing through transistor Q104. Current through current source 88 flows into second outer current mirror 94. Second outer current mirror 94 is a 1:1 current mirror such that current out of second current mirror 94 is the same as the current through current source 88. Since transistor Q104 is off, transistor Q106 sinks the current from second outer current mirror 94 and keeps it from saturating. Consequently, no current flows into or out of second inner current mirror 92, which is also a 1:1 mirror.

The outputs of first and second inner mirrors 91 and 92 combine to form compensation current $I_{comp}$ for circuit 80. As indicated, when first input voltage $V_{in1}$ is much less than second input voltage $V_{in2}$, the output of first inner current mirror 91 is one half of the current from current source 86 and the output from second inner current mirror 92 is zero. Consequently, compensation current $I_{comp}$ is one half of the current from current source 86 under these circumstances. Since transistor Q110 is off, all of the current from current source 86 is flowing through transistor Q91. Compensation current $I_{comp}$ then subtracts from the current from current source 86 leaving current one half the value of current source 86 flowing through transistor Q91. In this way, emitter current $I_{e91}$ through transistor Q91 is one half of the current through current source 86 when first input voltage $V_{in1}$ is much less than second input voltage $V_{in2}$.

When first input voltage $V_{in1}$ is equal to second input voltage $V_{in2}$, transistors Q91, Q97, Q104, and Q10 are all on. Thus, the current from current source 84 is split equally through transistors Q97 and Q104. Again, the current through current source 82, which is one half the current through current source 84, flows into first outer current mirror 93. Since first outer current mirror 93 is a 1:1 mirror, the output of first outer current mirror 93 is also one half the current through current source 84. Consequently, under this condition of balanced inputs, the current out of current mirror 93 equals the current through transistor Q97 and thus the net current into first inner current mirror 91 is zero. Since first inner current mirror 91 is also a 1:1 mirror, the current out of first inner current mirror 91 is zero.

Similarly, the current through current source 88, which is one half the current through current source 84, flows into second outer current mirror 94. Since second outer current mirror 94 is a 1:1 mirror, the output of the second outer current mirror 94 is also one half the current through current source 84. Consequently, under this condition of balanced inputs, the current out of second outer current mirror 94 equals the current through transistor Q104, and thus the net current into second inner current mirror 92 is zero. Since second inner current mirror 92 is also a 1:1 mirror, the current out of second inner current mirror 92 is zero.

Summing the currents out of first and second inner current mirrors 91 and 92 gives a total compensation current $I_{comp}$ of zero. Consequently, emitter current $I_{e91}$ in transistor Q91 is one half of the current through current source 86 when first input voltage $V_{in1}$ is equal to second input voltage $V_{in2}$. In this way, emitter current $I_{e91}$ in transistor Q91 is the same for when $V_{in1}$ is much less than $V_{in2}$ as it is for when $V_{in1}$ is equal to $V_{in2}$.

When first input voltage $V_{in1}$ is less than second input voltage $V_{in2}$, but within several $V_t$ of second input voltage $V_{in2}$, transistors Q91 and Q97 are on, but transistors Q104 and Q110 also begin to turn on. Thus, some of the current from current source 86 is split away from transistor Q91 into transistor Q110. By generating the variable compensation current $I_{comp}$ based upon first and second input voltages $V_{in1}$ and $V_{in2}$, however, circuit 80 keeps emitter current $I_{e91}$ in transistor Q91 constant, regardless of how close the two input voltages are to one another.

In fact, by generating the variable compensation current $I_{comp}$ based upon first and second input voltages $V_{in1}$ and $V_{in2}$, circuit 80 keeps the current density in the transistor of the emitter-connected pair with the lower input voltage constant, regardless of how close the two input voltages are to one another.

Although the present invention has been described with reference to preferred embodiments, workers skilled in the art will recognize that changes may be made in form and detail without departing from the spirit and scope of the invention.

What is claimed is:

1. A circuit for producing an output voltage as a function of a first input voltage and a second input voltage, the circuit comprising:

a first emitter-coupled transistor pair for receiving the first and second input voltages;

a compensation circuit coupled to receive the first and the second input voltage signals, the compensation circuit generating a compensation current at least partially based on a relative difference between the first and the second input voltage signals, the compensation circuit being coupled to the first emitter-coupled transistor pair such that the compensation circuit provides the compensation current to the first emitter-coupled transistor pair; and the output signal representative of either the first or the second input voltage.

2. The circuit of claim 1 wherein the compensation circuit further comprises:

a second emitter-coupled transistor pair coupled to the first and second input voltages;

first and second inner current mirrors coupled to the second emitter-coupled transistor pair;

first and second outer current mirrors coupled to the first and second inner current mirrors; and first and second clamping circuits coupled to the first and second outer current mirrors.

3. The circuit of claim 2 further including a first current source coupled to the first outer current mirror, a second current source coupled to the second outer current mirror, a third current source coupled to the first emitter-coupled transistor pair, and a fourth current source coupled to the second emitter-coupled transistor pair.

4. The circuit of claim 3 wherein the first emitter-coupled transistor pair includes a first and a second transistor, each having a base, an emitter and a collector, and wherein the first input voltage is coupled to the base of the first transistor, the second input voltage is coupled to the base of the second transistor, and the compensation circuit is coupled to the emitters of the first and second transistors such that the compensation current is directed into the emitter of either the first or second transistor.

5. The circuit of claim 4 wherein the compensation current is directed into the emitter the first transistor when the first input voltage is slightly higher than the second input voltage, wherein the compensation current is directed into the emitter of the second transistor when the second input voltage is slightly higher than the second input voltage, wherein the compensation current is zero when the first input voltage is much greater than the second input voltage, wherein the compensation current is zero when the second input voltage is much greater than the first input voltage, and wherein the output voltage is representative of the greater of the first and the second input voltages.

6. The circuit of claim 4 wherein the compensation current is directed into the emitter the first transistor when the first input voltage is slightly less than the second input voltage, wherein the compensation current is directed into the emitter of the second transistor when the second input voltage is slightly less than the second input voltage, wherein the compensation current is zero when the first input voltage is much less than the second input voltage, wherein the compensation current is zero when the second input voltage is much less than the first input voltage, and wherein the output voltage is representative of the lessor of the first and the second input voltages.

7. A method for comparing a first input voltage and a second input voltage with an emitter-coupled transistor pair to provide an output voltage, the method comprising:

providing the first input voltage to a first transistor of the emitter-coupled pair and, and providing the second input voltage to a second transistor of the emitter-coupled pair;

generating a variable compensation current, the compensation current being based upon a relative difference between the first and the second input signals;

providing the compensation current to the emitter-coupled transistor pair; and, generating the output voltage representative of either the first or the second input voltage, the output voltage at least partially based on the compensation current.

8. The method of claim 7 wherein the output voltage represents the first input voltage when the first input voltage is higher than the second input voltage and wherein the output voltage represents the second input voltage when the second input voltage is higher than the first input voltage.

9. The method of claim 7 wherein the first transistor has an emitter current and wherein providing the compensation current to the emitter-coupled transistor pair keeps the emitter current in the first transistor constant when the first input voltage is higher than the second input voltage.

10. The method of claim 7 wherein the second transistor has an emitter current and wherein providing the compensation current to the emitter-coupled transistor pair keeps the emitter current in the second transistor constant when the second input voltage is higher than the first input voltage.

11. The method of claim 7 wherein the output voltage represents the first input voltage when the first input voltage is less than the second input voltage and wherein the output voltage represents the second input voltage when the second input voltage is less than the first input voltage.

12. The method of claim 7 wherein the first transistor has an emitter current and wherein providing the compensation current to the emitter-coupled transistor pair keeps the emitter current in the first transistor constant when the first input voltage is less than the second input voltage.

13. The method of claim 7 wherein the second transistor has an emitter current and wherein providing the compensation current to the emitter-coupled transistor pair keeps the emitter current in the second transistor constant when the second input voltage is less than the first input voltage.

* * * * *

UNITED STATES PATENT AND TRADEMARK OFFICE

CERTIFICATE OF CORRECTION

PATENT NO. : 5,825,168

DATED : OCTOBER 20, 1998

INVENTOR(S) : KURT N. KIMBER

It is certified that error appears in the above-identified patent and that said Letters Patent is hereby corrected as shown below:

Col. 13, line 42, delete "Q10", insert --Q110--

Col. 15, line 32, delete first occurrence of "and"

Signed and Sealed this

Twenty-sixth Day of October, 1999

*Attest:*

Q. TODD DICKINSON

*Attesting Officer*

*Acting Commissioner of Patents and Trademarks*